US009750657B2

(12) United States Patent
Drake

(10) Patent No.: US 9,750,657 B2
(45) Date of Patent: Sep. 5, 2017

(54) ACCESSORY FLAT-TOP PANEL FOR USE WITH SURGICAL TABLES

(71) Applicant: Allen Medical Systems, Inc., Batesville, IN (US)

(72) Inventor: Jesse S. Drake, Westborough, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 239 days.

(21) Appl. No.: 14/477,559

(22) Filed: Sep. 4, 2014

(65) Prior Publication Data

US 2015/0113732 A1 Apr. 30, 2015

Related U.S. Application Data

(60) Provisional application No. 61/897,666, filed on Oct. 30, 2013.

(51) Int. Cl.

| | |
|---|---|
| ***A61G 13/12*** | (2006.01) |
| ***A61G 13/04*** | (2006.01) |
| ***A61G 13/06*** | (2006.01) |
| ***A61G 13/10*** | (2006.01) |

(52) U.S. Cl.

CPC ..... *A61G 13/128* (2013.01); *A61G 13/04* (2013.01); *A61G 13/06* (2013.01); *A61G 13/101* (2013.01); *A61G 13/104* (2013.01); *A61G 13/121* (2013.01); *A61G 13/122* (2013.01); *A61G 13/123* (2013.01); *A61G 13/1245* (2013.01); *A61G 2200/322* (2013.01); *A61G 2200/325* (2013.01); *A61G 2200/327* (2013.01)

(58) Field of Classification Search

CPC ..... A61G 13/00; A61G 13/0036; A61G 13/0054; A61G 13/04; A61G 13/06; A61G 13/08; A61G 13/10; A61G 13/101; A61G 13/104; A61G 13/121; A61G 13/122; A61G 13/1225; A61G 13/123; A61G 13/1245; A61G 13/128; A61G 13/1285; A61G 2200/322; A61G 2200/325; A61G 2200/327

See application file for complete search history.

(56) References Cited

U.S. PATENT DOCUMENTS

| | | | | |
|---|---|---|---|---|
| 3,046,072 A | | 7/1962 | Douglass et al. | |
| 3,530,515 A | * | 9/1970 | Jacoby | A61G 7/0501 128/200.24 |
| 4,018,412 A | | 4/1977 | Kees et al. | |
| 4,143,652 A | | 3/1979 | Meier et al. | |
| 4,526,355 A | | 7/1985 | Moore et al. | |
| 4,653,482 A | * | 3/1987 | Kurland | A61G 13/12 5/601 |
| 4,796,846 A | | 1/1989 | Meier et al. | |

(Continued)

*Primary Examiner* — Nicholas Polito

(74) *Attorney, Agent, or Firm* — Barnes & Thornburg LLP

(57) ABSTRACT

An accessory flat-top panel for use with a surgical table includes a board adapted to support a patient, a left attachment pylon coupled to the board, and a right attachment pylon coupled to the board. The left and right attachment pylons are each formed to include channels sized to receive a rail included in a surgical table. The width of the board between a left side and a right side of the board is greater than the width of a pair of rails included in a surgical table to support portions of a patient wider than pair of rails included in the support top.

11 Claims, 4 Drawing Sheets

(56) References Cited

U.S. PATENT DOCUMENTS

| | | | | |
|---|---|---|---|---|
| 4,971,037 | A | 11/1990 | Pelta et al. | |
| 4,989,848 | A | 2/1991 | Monroe | |
| 5,088,706 | A | 2/1992 | Jackson et al. | |
| 5,135,210 | A | 8/1992 | Michelson | |
| 5,276,927 | A | 1/1994 | Day et al. | |
| 5,287,575 | A | 2/1994 | Allen et al. | |
| 5,613,254 | A | 3/1997 | Clayman et al. | |
| 5,926,876 | A | 7/1999 | Haigh et al. | |
| 6,260,220 | B1 | 7/2001 | Lamb et al. | |
| 6,622,980 | B2 | 9/2003 | Boucher et al. | |
| 6,663,055 | B2 | 12/2003 | Boucher et al. | |
| 6,691,350 | B2 | 2/2004 | Weismiller | |
| 7,520,007 | B2 | 4/2009 | Skripps | |
| 8,397,323 | B2 | 3/2013 | Skripps et al. | |
| 8,635,725 | B2 | 1/2014 | Tannoury et al. | |
| 8,833,707 | B2 | 9/2014 | Steinberg et al. | |
| 2001/0044971 | A1* | 11/2001 | Borders | A61G 13/10 5/691 |
| 2012/0124742 | A1* | 5/2012 | Soto | A61G 13/101 5/600 |

* cited by examiner

ACCESSORY FLAT-TOP PANEL FOR USE WITH SURGICAL TABLES

This application claims the benefit, under 35 U.S.C. §119(e), of U.S. Provisional Application No. 61/897,666, which was filed Oct. 30, 2013, and which is hereby incorporated by reference herein in its entirety

BACKGROUND

The present disclosure is related to surgical tables and accessories for surgical tables. More particularly, the present disclosure relates to accessory panels that attach to surgical tables and that are configured to support a patient during various types of surgery.

Some specialized surgical tables and accessory supports used with those tables have been developed for specific orthopedic surgeries. A subset of these specialized orthopedic surgical tables include, for example, the "Jackson" table which was designed specifically for spinal surgery. Examples of the "Jackson" table may be found in U.S. Pat. Nos. 5,088,706; 5,131,106; 5,613,254; and 6,260,220. Accessories for the various types of Jackson tables are similarly geared toward spinal surgeries. The various types of Jackson tables and accessories used therewith are generally very expensive and are only used for a small percentage of surgeries that may be performed in a hospital or clinic.

SUMMARY

The present application discloses one or more of the features recited in the appended claims and/or the following features which, alone or in any combination, may comprise patentable subject matter:

According to the present disclosure, an accessory flat-top panel for use with a surgical table may include a board, a left attachment pylon, and a right attachment pylon. The board may be adapted to support at least a portion of a patient and may have a front, a back opposite the front, a left side, a right side opposite the left side, a top, and a bottom opposite the top. The left attachment pylon may be coupled to the board and may be arranged along a left side of the board. The left attachment pylon may include a first rail receiver formed to include a channel sized to receive at least a portion of a rail included in a surgical table and a first latch movable relative to the first rail receiver. The first latch may move a disengaged position in which the first latch allows movement of the first rail receiver relative to a rail received in the first rail receiver to an engaged position in which the first latch resists movement of the first rail receiver relative to a rail received in the first rail receiver. The right attachment pylon may be coupled to the board and may be arranged along a right side of the board. The right attachment pylon may include a second rail receiver formed to include a channel sized to receive at least a portion of a rail included in a surgical table and a second latch movable relative to the second rail receiver. The latch may move from a disengaged position in which the second latch allows movement of the second rail receiver relative to a rail received in the second rail receiver to an engaged position in which the second latch resists movement of the second rail receiver relative to a rail received in the second rail receiver.

In some embodiments, the channel formed by the left attachment pylon and the channel formed by the right attachment pylon may be arranged within a width of the board. Specifically, the channels formed by the left and right attachment pylons may be arranged within the width of the board when the accessory flat-top panel is viewed from the front of the board.

In some embodiments, the left attachment pylon and the right attachment pylon may be the arranged within a footprint of the board. Specifically, the left attachment pylon and the right attachment pylon may be arranged within a footprint of the board when the accessory flat-top panel is viewed from above the top of the board at a time when the first latch is in the engaged position and the second latch is in the engaged position.

In some embodiments, the accessory flat-top panel may include a secondary-accessory rail. The secondary-accessory rail may be configured to support a secondary accessory. The secondary-accessory rail may be arranged to extend along at least a portion of either the left side or the right side of the board and may be coupled to either the left attachment pylon or the right attachment pylon.

In some embodiments, the accessory flat-top panel may include another second-accessory rail configured to support a secondary accessory. The secondary-accessory rails may be arranged to extend along opposing left and right sides of the board. Each of the second-accessory rails may include a beam arranged outside the footprint of the board when the accessory flat-top panel is viewed from above the top side of the board and a plurality of spacers extending from the beam toward the board.

In some embodiments, the first latch may be coupled to the first rail receiver to pivot relative to the first rail receiver about a first latch axis to move from the disengaged position to the engaged position. The first rail receiver included in the left attachment pylon and may form a downwardly-opening channel that faces away from the board.

In some embodiments, the left attachment pylon may include a third rail receiver sized to receive at least a portion of a rail included in a surgical table and a third latch movable relative to the third rail receiver. The third latch may be movable from a disengaged position in which the third latch allows movement of the third rail receiver relative to a rail received in the third rail receiver to an engaged position in which the third latch resists movement of the third rail receiver relative to a rail received in the third rail receiver. The first rail receiver and the first latch of the left attachment pylon may cooperate to form a first clamp arranged along the front of the board. The third rail receiver and the third latch may cooperate to form a second clamp spaced apart from the first clamp and arranged along the back side of the board. The left attachment pylon may include a coupler beam coupled to the board that extends from the first clamp to the second clamp along most of the left side of the board.

According to another aspect of the present disclosure, a surgical support may include a foundation frame, a support top mounted to the foundation frame, and an accessory flat-top panel. The support top may include a left rail, a right rail, a first crossbeam that extends from the left rail to the right rail, and a second crossbeam that extends from the left rail to the right rail. The accessory flat-top panel may be coupled to the left rail and to the right rail.

In some embodiments, the accessory flat-top panel may include a board, a first clamp coupled to the board and engaged with the left rail of the support top, and a second clamp coupled to the board and engaged with the right rail of the support top. The width of the board between a left side and a right side of the board may be greater than the width of the support top between a left side of the left rail and a right side of the right rail to support portions of a patient wider than the support top.

In some embodiments, the first clamp, the second clamp, the left rail, and the right rail may be arranged within a footprint of the board when viewed from above a top side of the board. The accessory flat-top panel may include a left secondary-accessory rail arranged to extend along a left side of the board and a right secondary-accessory rail arranged to extend along a right side of the board. Each of the left secondary accessory rail and the right secondary-accessory rail may extend outside of the footprint of the board when the accessory flat-top panel is viewed from above the top side of the board.

In some embodiments, the first clamp may include a first rail receiver sized to receive at least a portion of the left rail and a first latch movable relative to the first rail receiver. The first latch may move from a disengaged position in which the first latch allows movement of the first rail receiver relative to the left rail to an engaged position in which the first latch resists movement of the first rail receiver relative to the left rail. The first rail receiver included in the first clamp may form a downwardly-opening channel that faces away from the board. The first latch may be coupled to the first rail receiver to pivot relative to the first rail receiver about a first latch axis that extends parallel to the left rail to move from the disengaged position to the engaged position.

In some embodiments, the accessory flat-top panel may include a third clamp and a fourth clamp arranged within a footprint of the board when the accessory flat-top panel is viewed from above a top side of the board. The third clamp may be coupled to the board and engaged with the left rail. The fourth clamp may be coupled to the board and engaged with the right rail.

In some embodiments, each of the clamps may include a rail receiver that receives at least a portion of the left or right rail of the support top and a latch movable relative to the rail receiver. The latches may move from a disengaged position in which the latch allows movement of the rail receiver relative to the left or right rail to an engaged position in which the latch resists movement of the rail receiver relative to the left or right rail.

In some embodiments, the foundation frame may include a central connection member, a first column coupled to a first end of the central connection member and arranged to extend upwardly from the central connection member, and a second column coupled to a second end of the central connection member opposite the first end of the central connection member and arranged to extend upwardly from the central connection member. The support top may extend between the first column and the second column and may be mounted to the first column and the second column for movement about a support-top axis relative to the first column and the second column.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
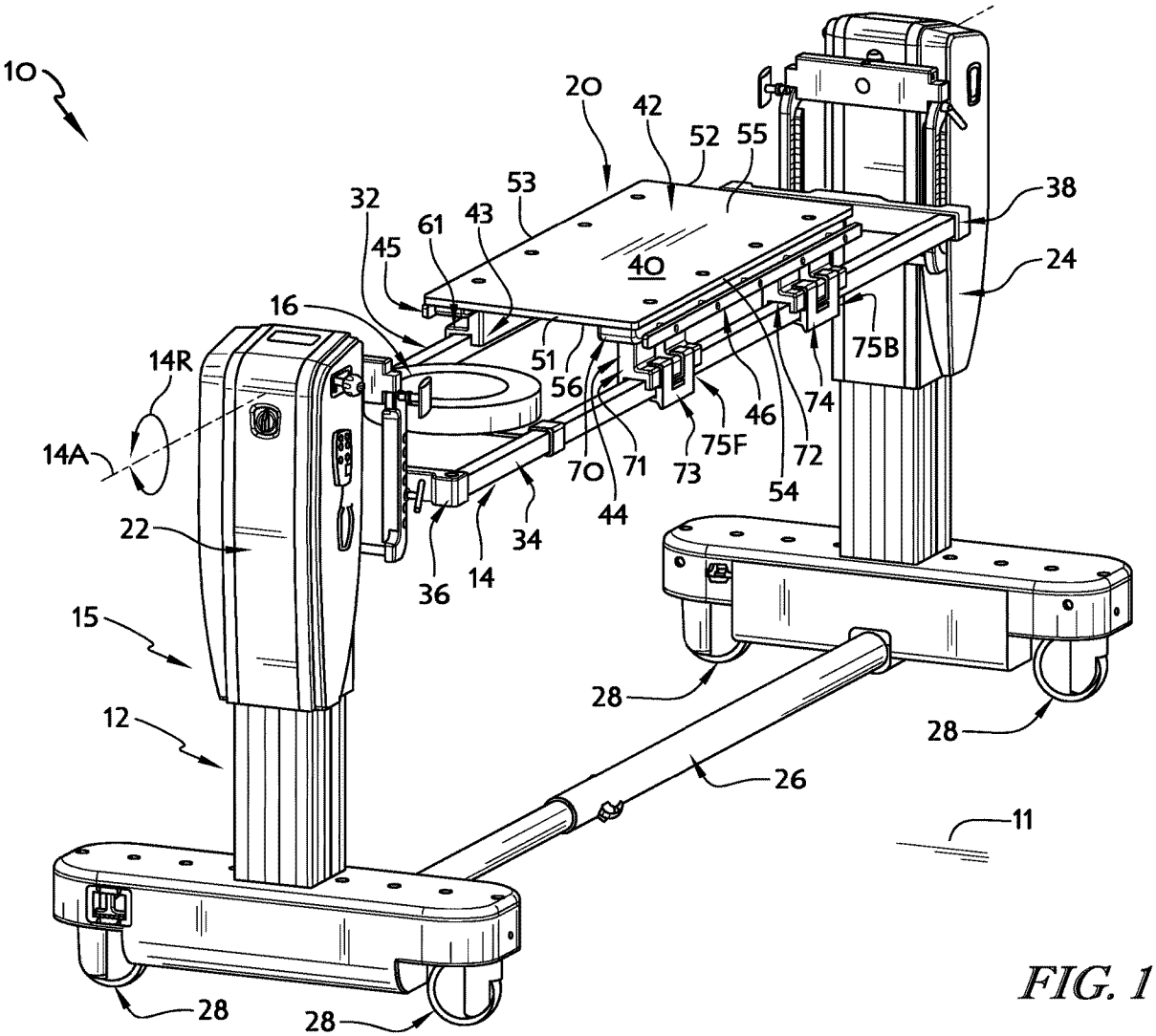
FIG. 1 is a perspective view of a patient support apparatus adapted to support a patient during surgery showing that the patient support apparatus includes a dual-column foundation frame, a support top having left and right rails that extends between columns of the dual-column foundation frame, a number of accessory flat-top panels coupled to the left and right rails of the support top to support a patient lying on the patient support apparatus, and a head support accessory coupled to the left and right rails of the support top.

An illustrative surgical support 10 is adapted to support a patient in a generally supine position during surgery as shown, for example, in FIG. 1. The illustrative surgical support 10 includes a foundation frame 12, a support top 14 coupled to the foundation frame 12, and a plurality of accessories 16, 20 coupled to the support top 14. The foundation frame 12 supports support top 14 along with accessories 16, 20 above a floor 11. In the illustrative embodiment, the support top 14 is mounted to the foundation frame 12 to provide a surgical table 15. The accessories 16, 20 are mounted to the support top 14.

Figure 5:
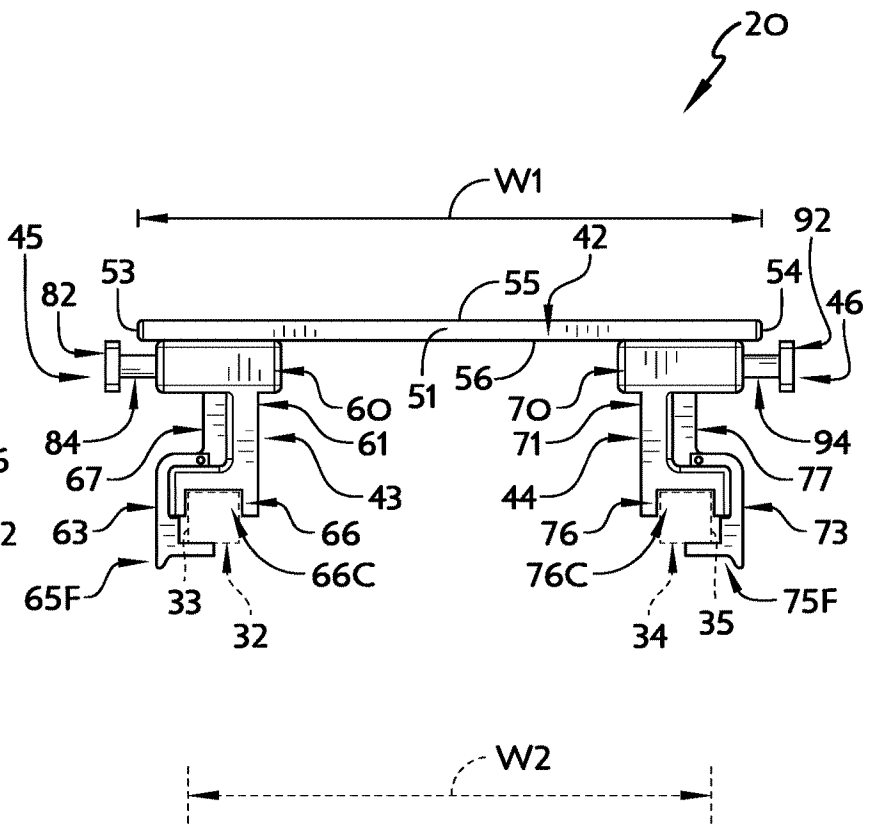
FIG. 5 is a side elevation view of the accessory flat-top panel of FIGS. 1-4 showing that the struts of the left and right attachment pylons extend between the board and the support top so that the board is spaced apart from the support top when the accessory flat-top panel is coupled to the support top.

The specific accessories 16, 20 used with the surgical table 15 include an accessory head support 16 and an accessory flat-top panel 20 as shown in FIG. 1. The accessory head support 16 and the accessory flat-top panel 20 cooperate to provide support for a patient similar to the support provided by a traditional operating room table so that the patient can be arranged in a variety of positions for a variety of surgeries. The accessory flat-top panel 20 illustratively provides a support surface 40 that is wider than the support top 14, as shown in FIGS. 1 and 5, so that the accessory flat-top panel 20 may be used to support portions of a patient that are wider than the support top 14.

The foundation frame 12 is illustratively a dual-column foundation frame that includes a first column 22, a second column 24, and a central connection member 26 as shown in FIG. 1. The first column 22 and the second column 24 are spaced apart from one another and are fitted with wheels 28 so that the surgical support 10 is adapted to roll along the floor 11. The central connection member 26 extends between and interconnects the first column 22 with the second column 24. In other embodiments, other foundation frames adapted to hold a support top above a floor may be used with the accessories 16, 20. In other embodiments, other foundational frames may be used to support a support top having two rails above a floor.

The support top 14 is illustratively coupled to the foundation frame 12 to rotate relative to the foundation frame 12 about a support-top axis 14A as suggested by arrow 14R in FIG. 1. The support top 14 illustratively includes a left rail 32, a right rail 34, a head-end crossbeam 36, and a foot-end crossbeam 38. The left and right rails 32, 34 are spaced apart from one another and extend between the first and second columns 22, 24 of the foundation frame 12. The head-end crossbeam 36 interconnects head ends of the left rail 32 and the right rail 34. The foot-end crossbeam 38 interconnects foot ends of the left rail 32 and the right rail 34. Additional description of the foundation frame 12 and of the support top 14 is included in U.S. patent application Ser. No. 13/789,037, filed on Mar. 17, 2013, which is hereby incorporated by reference herein in its entirety.

The accessories 16, 20 are modular and are interchangeable with other accessories as suggested in FIG. 1. Each of the accessories 16, 20 may be used in other combinations with the surgical table 15 to support patients in various positions (supine, prone, side-lying, etc.) for specialized or general surgeries. The accessory head support 16 is coupled to the support top 14 at a head end of the support top 14 and is configured to support the head of a patient on the surgical support 10. The accessory flat-top panel 20 is also coupled to the support top 14 and is configured to support the torso and legs of a patient on the surgical support 10. In other embodiments, accessory flat-top panels may be sized for use alone or with other accessory flat-top panels. Such accessory flat-top panels may provide a segmented or un-segmented support surface of a desired size to support smaller or larger portions of a patient.

Figure 2:
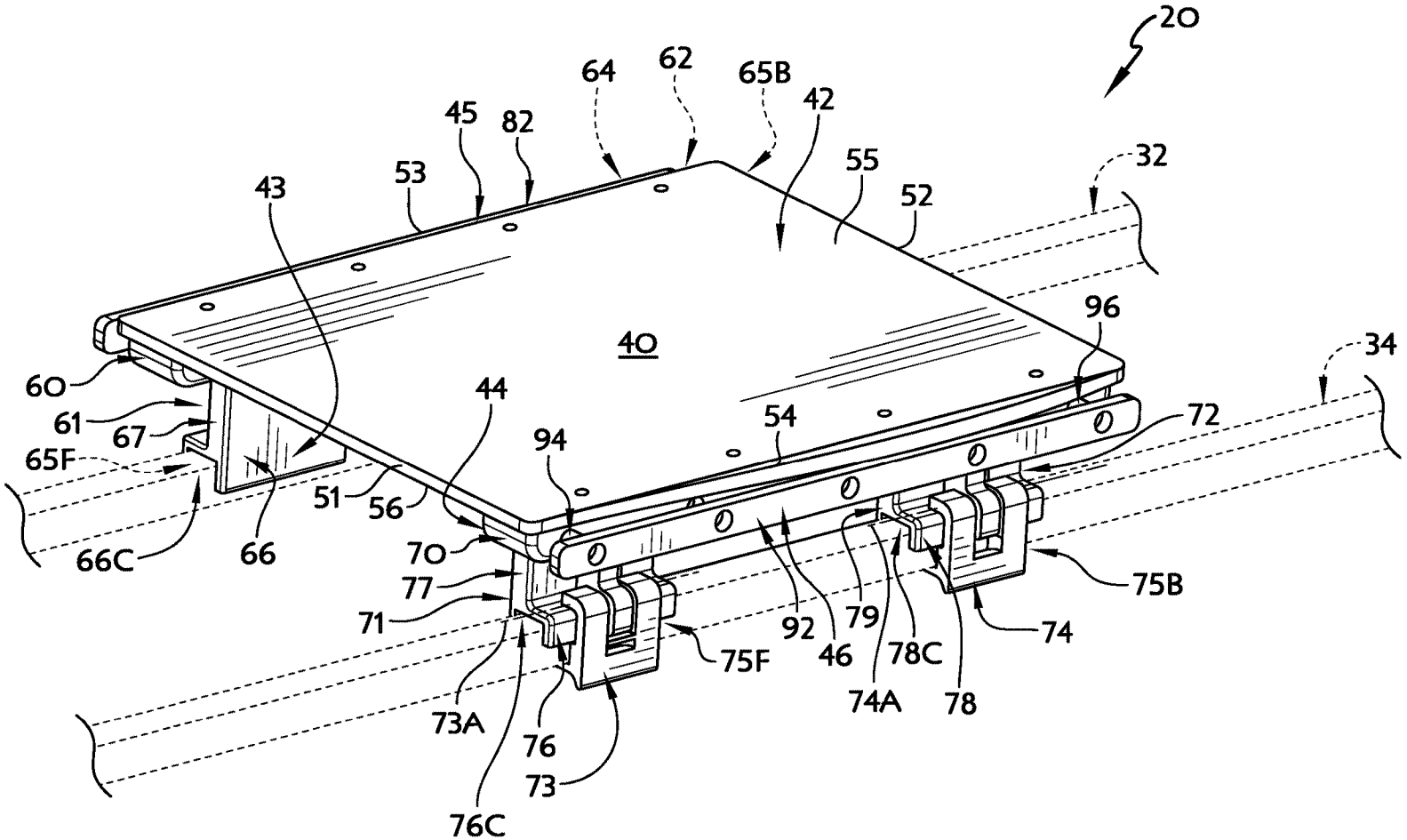
FIG. 2 is a detail perspective view of the accessory flat-top panel shown in FIG. 1 removed from the patient support apparatus to show that the accessory includes a board adapted to support a patient, secondary accessory rails arranged along opposing sides of the board to support various other accessories, and left and right attachment pylons adapted to engage the left and right rails of the support top.

The accessory flat-top panel 20 illustratively includes a board 42, left and right attachment pylons 43, 44, and left and right secondary-attachment rails 45, 46 as shown in FIG. 2. The board 42 is illustratively made from a phenolic, radiolucent material and is configured to support a patient. The left and right attachment pylons 43, 44 are coupled to the board 42 by threaded fasteners (not shown) and are configured to selectively engage the support top 14 of the surgical table 15. The left and right secondary-attachment rails 45, 46 are coupled to a corresponding left or right attachment pylon 43, 44 by threaded fasteners (not shown) and are configured to support a secondary accessory adapted for use with the surgical table 15.

Figure 3:
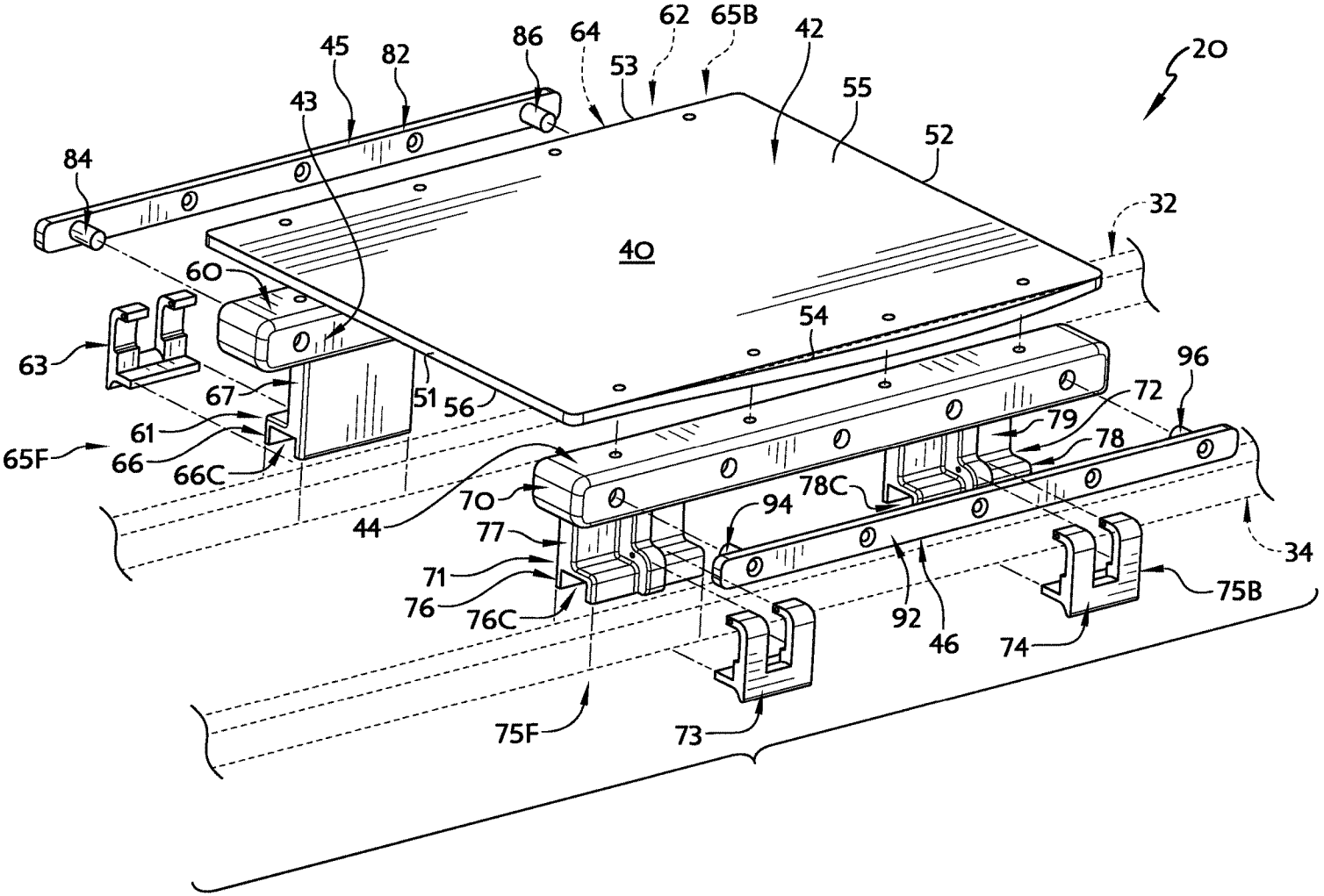
FIG. 3 is an exploded assembly view of the accessory flat-top panel of FIGS. 1 and 2 showing that the left and right attachment pylons are attached to the board and to a corresponding left and right secondary accessory rail by threaded fasteners and showing that each of the left and right attachment pylons includes a coupler beam that extends along a side of the board, front and back struts extending downwardly from the coupler beam, and front and back latches coupled to corresponding struts to pivot about a pivot axis to a rail of the support top received in a rail-receiver channel formed by the corresponding strut.

The board 42 provides support surface 40 and is generally flat as shown in FIGS. 2 and 3. The board 42 is illustratively rectangular and has a front 51, a back 52, a left side 53, a right side 54, a top 55 and a bottom 56. The board 42 has a width W1 between the left side 53 and the right side 54 of the board 42. The width W1 is greater than a width W2 of the support top 14 between a left side 33 of left rail 32 and a right side 35 of the right rail 34 as shown in FIG. 5. In the illustrative embodiment, the width W1 is about twenty inches but in other embodiments may be larger or smaller. In some embodiments, the board 42 may be fitted with pads that extends over the top 55 of the board 42 to provide pressure management.

Figure 4:
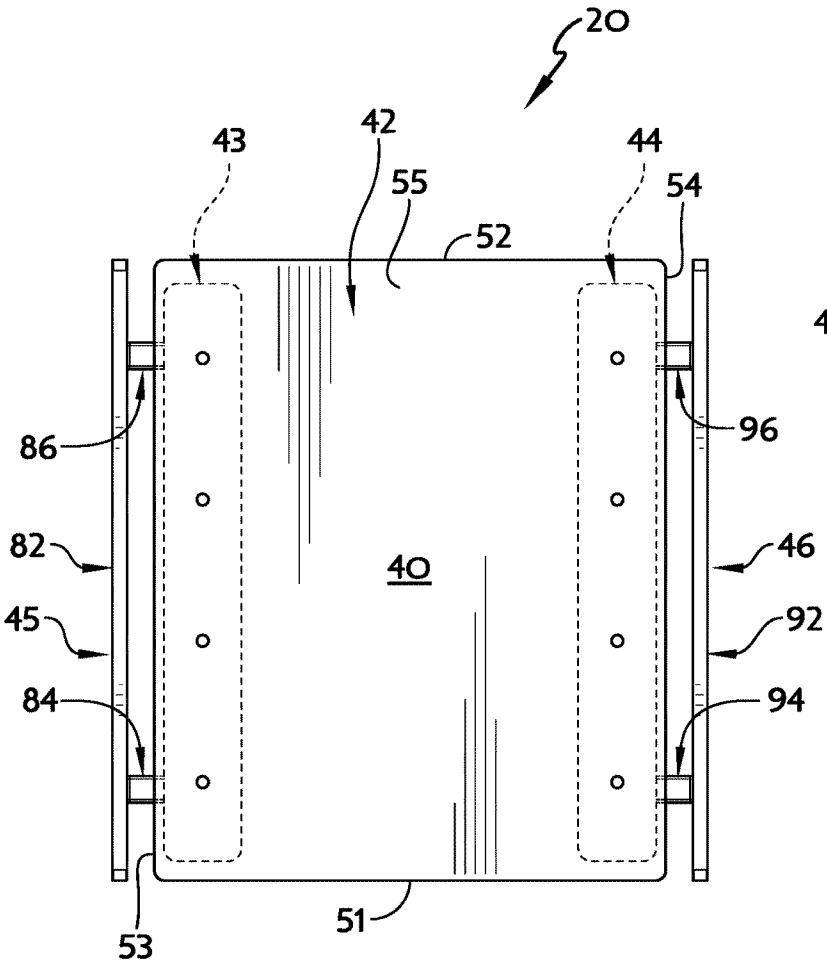
FIG. 4 is a top plan view of the accessory flat-top panel of FIGS. 1-3 showing that the left and right attachment pylons are arranged inside a footprint of the board as viewed from above when the latches of the attachment pylons are pivoted to engage the left and right rails of the support top.

The left and right attachment pylons 43, 44 extend downwardly from the board 42 and extend along corresponding left and right sides 53, 54 of the board 42 as shown in FIG. 2. The left and right attachment pylons 43, 44 are illustratively arranged within a footprint of the board 42 when the accessory flat-top panel 20 is viewed from above the top 55 of the board 42 as shown in FIG. 4. The left and right attachment pylons 43, 44 are overhung by the board 42 when the accessory flat-top panel 20 is viewed from above the front 51 of the board 42 as shown in FIG. 5.

The left attachment pylon 43 illustratively includes a coupler beam 60, front and back struts 61, 62, and front and back latches 63, 64 as shown in FIG. 3. The coupler beam 60 engages the bottom 56 of the board 42 and extends along most of the left side 53 of the board 42. The front strut 61 extends down from the coupler beam 60 at the front 51 of the board 42. The back strut 62 is spaced apart from the front strut 61 and extends down from the coupler beam 60 at the back 52 of the board 42. In the illustrative embodiment, the coupler beam 60, the front strut 61 and the back strut 62 are formed as a monolithic metallic component. Front latch 63 is coupled to front strut 61 to pivot about a latch axis 63A as shown in FIG. 2. Back latch 64 is coupled to back strut 62 to pivot about a latch axis 64A as shown in FIG. 2.

The front strut 61 illustratively includes a rail receiver 66 and a riser 67 as shown in FIG. 3. The rail receiver 66 has an inverted U-shape and forms a downwardly-opening channel 66C sized to receive a portion of the left rail 32 included in the support top 14. The rail receiver 66 of the front strut 61 cooperates with the front latch 63 to form a front clamp 65F that engages the left rail 32 of the support top 14 at the front 51 of the board 42. The riser 67 extends from the rail receiver 66 to the coupler beam 60 and spaces the rail receiver 66 from the coupler beam 60 and the board 42. The coupler beam 60, the rail receiver 66, and the riser 67 cooperate to form a left-opening channel facing away from the right attachment pylon 44 and sized to allow the latch 63 to pivot into the channel when it is in the disengaged position.

The back strut 62 illustratively includes a rail receiver 68 and a riser 69 as shown in FIG. 3. The rail receiver 68 has an inverted U-shape and forms a downwardly-opening channel 68C sized to receive a portion of the left rail 32 included in the support top 14. The rail receiver 68 of the back strut 62 cooperates with the back latch 64 to form a back clamp 65B that engages the left rail 32 of the support top 14 at the back 52 of the board 42. The riser 69 extends from the rail receiver 68 to the coupler beam 60 and spaces the rail receiver 68 from the coupler beam 60 and the board 42. The coupler beam 60, the rail receiver 68, and the riser 69 cooperate to form a right-opening channel facing away from the left attachment pylon 43 and sized to allow the latch 64 to pivot into the channel when it is in the disengaged position.

The front and back latches 63, 64 included in the left attachment pylon 43 are each illustratively C-shaped as shown in FIG. 3. Each of the front and back latches 63, 64 are similar to front and back latches 73, 74 of the right attachment pylon 44 and move about a corresponding latch axes from a disengaged position to an engaged position. In the disengaged position latches of the left attachment pylon 43 allow movement of a corresponding rail receiver included in the left rail receiver 43 relative to the left rail 32. In the engaged position latches of the left 63, 64 attachment pylon 43 resist movement of a corresponding rail receiver included in the left rail receiver 43 relative to the left rail 32. In other embodiments, other types of latches (set screws, cam locks, spring latches, etc.) may be used to engage the left rail 32.

The right attachment pylon 44 illustratively includes a coupler beam 70, front and back struts 71, 72, and front and back latches 73, 74 as shown in FIG. 3. The coupler beam 70 engages the bottom 56 of the board 42 and extends along most of the right side 54 of the board 42. The front strut 71 extends down from the coupler beam 70 at the front 51 of the board 42. The back strut 72 is spaced apart from the front strut 71 and extends down from the coupler beam 70 at the back 52 of the board 42. In the illustrative embodiment, the coupler beam 70, the front strut 71, and the back strut 72 are formed as a monolithic metallic component. Front latch 73 is coupled to front strut 71 to pivot about a latch axis 73A as shown in FIG. 2. Back latch 74 is similarly coupled to back strut 72 to pivot about a latch axis.

The front strut 71 illustratively includes a rail receiver 76 and a riser 77 as shown in FIG. 3. The rail receiver 76 has an inverted U-shape and forms a downwardly-opening channel 76C sized to receive a portion of the right rail 34 included in the support top 14. The rail receiver 76 of the front strut 71 cooperates with the front latch 73 to form a front clamp 75F that engages the right rail 34 of the support top 14 at the front 51 of the board 42. The riser 77 extends from the rail receiver 76 to the coupler beam 70 and spaces the rail receiver 76 from the coupler beam 60 and the board 42. The coupler beam 70, the rail receiver 76, and the riser 77 cooperate to form a left-opening channel facing away from the right attachment pylon 44 and sized to allow the latch 73 to pivot into the channel when it is in the disengaged position.

The back strut 72 illustratively is similar to the back strut 62 of the left attachment pylon 43 shown in FIG. 3. The back strut 72 includes a rail receiver and a riser. The rail receiver of the back strut 72 has an inverted U-shape and forms a downwardly-opening channel sized to receive a portion of the right rail 34 included in the support top 14. The rail receiver of the back strut 72 cooperates with a back latch to form a back clamp 75B that engages the right rail 34 of the support top 14 at the back 52 of the board 42. The riser of the back strut 72 extends from the rail receiver of the back strut 72 to the coupler beam 70 and spaces the rail receiver of the back strut 72 from the coupler beam 70 and the board 42. The coupler beam 70, the rail receiver 78, and the riser 79 cooperate to form a left-opening channel facing away from the left attachment pylon 43 and sized to allow the latch 74 to pivot into the channel when it is in the disengaged position.

The front and back latches 73, 74 are each illustratively C-shaped as shown in FIG. 3. Each of the front and back latches 73, 74 move about a corresponding latch axis 73A, 74A from a disengaged position to an engaged position. In the disengaged position the front and back latches 73, 74 allow movement of a corresponding rail receiver 76, 78 relative to the right rail 34 received in the corresponding rail receiver 76, 78. In the engaged position the front and back latches 73, 74 resist movement of a corresponding rail receiver 76, 78 relative to the right rail 34 received in the corresponding rail receiver 76, 78. In other embodiments, other types of latches (set screws, cam locks, spring latches, etc.) may be used to engage the right rail 34. Additional description of the clamps 65F, 65B, 75F, 75B, including additional description of the latches 63, 64, 73, 74, is included in U.S. Pat. No. 7,520,007 filed on Apr. 22, 2006, which is hereby incorporated by reference herein in its entirety.

The left secondary-attachment rail 45 includes a beam 82 and a plurality of spacer standoffs 84, 86 as shown in FIG. 3. The beam 82 is illustratively made from stainless steel and is machined to match the dimensions of standard operating room table rails so that they can be engaged by the jaws of one or more secondary accessories. Examples of secondary accessories that may be used with the left secondary-attachment rail 45 include arm positioners, leg positioners, armboards, retractors, beach-chair shoulder positioners, and the like. The beam 82 is arranged outside the footprint of the board 42 when the accessory flat-top panel 20 is viewed from above the top side 55 of the board 42 as shown in FIG. 4. The spacer standoffs 84, 86 extend from the beam 82 to the coupler beam 60 included in the left attachment pylon 43 inside the footprint of the board 42 when viewed from above. Fasteners (not shown) extend through the beam 82, the spacer standoffs 84, 86, and into the coupler beam 60 of the left attachment pylon 43 to secure the left secondary-attachment rail 45 to the left attachment pylon 43.

The right secondary-attachment rail 46 is similar to left secondary-attachment rail as shown in FIG. 3. The right secondary-attachment rail 46 includes a beam 92 and a plurality of spacer standoffs 94, 96 as shown in FIG. 3. The beam 92 is sized to be engaged by the jaws of a secondary accessory. Examples of secondary accessories that may be used with the right secondary-attachment rail 46 include arm positioners, leg positioners, armboards, retractors, beach-chair shoulder positioners, and the like. The beam 92 is arranged outside the footprint of the board 42 when the accessory flat-top panel 20 is viewed from above the top side 55 of the board 42 as shown in FIG. 4. The spacer standoffs 94, 96 extend from the beam 92 to the coupler beam 70 included in the right attachment pylon 44 inside the footprint of the board 42 when viewed from above. Fasteners (not shown) extend through the beam 92, the spacer standoffs 94, 96, and into the coupler beam 70 of the right attachment pylon 44 to secure the right secondary-attachment rail 46 to the right attachment pylon 44.

In accordance with the present disclosure, an accessory flat-top panel is configured to removeably mount to the rails of various types of Jackson tables and/or similar surgical tables. Use of the accessory flat-top panel 20 disclosed herein allows a Jackson (or similar) surgical table to be used for a variety of surgeries. For example a surgical support including a Jackson (or similar) surgical table and the accessory flat-top panel 20 of the present disclosure may be used for spinal surgeries, shoulder surgeries, hip surgeries, and other various types of surgery.

Although certain illustrative embodiments have been described in detail above, variations and modifications exist within the scope and spirit of this disclosure as described and as defined in the following claims.

The invention claimed is:

1. An accessory flat-top panel for use with a surgical table, the accessory flat-top panel comprising a board adapted to support at least a portion of a patient, the board having a front, a back opposite the front, a left side, a right side opposite the left side, a top, and a bottom opposite the top, a left attachment pylon coupled to the board and arranged along a left side of the board, the left attachment pylon including a first rail receiver formed to include a channel sized to receive at least a portion of a rail included in a surgical table and a first latch movable relative to the first rail receiver from a disengaged position in which the first latch allows movement of the first rail receiver relative to a rail received in the first rail receiver to an engaged position in which the first latch resists movement of the first rail receiver relative to a rail received in the first rail receiver, a right attachment pylon coupled to the board and arranged along a right side of the board, the right attachment pylon including a second rail receiver formed to include a channel sized to receive at least a portion of a rail included in a surgical table and a second latch movable relative to the second rail receiver from a disengaged position in which the second latch allows movement of the second rail receiver relative to a rail received in the second rail receiver to an engaged position in which the second latch resists movement of the second rail receiver relative to a rail received in the second rail receiver, and a secondary-accessory rail configured to support a secondary accessory, the secondary-accessory rail spaced apart from the board, arranged to extend along at least a portion of either the left side or the right side of the board, and coupled directly to either the left attachment pylon or the right attachment pylon, wherein the channel formed by the left attachment pylon and the channel formed by the right attachment pylon are arranged within a width of the board when the accessory flat-top panel is viewed from the front of the board, and wherein the second-accessory rail includes a beam arranged outside the footprint of the board when the accessory flat-top panel is viewed from above the top side of the board and a plurality of spacers extending from the beam toward the board.

2. The accessory flat-top panel of claim 1, wherein the left attachment pylon and the right attachment pylon are the arranged within a footprint of the board when the accessory flat-top panel is viewed from above the top of the board at a time when the first latch is in the engaged position and the second latch in the engaged position.

3. The accessory flat-top panel of claim 1, further comprising another secondary-accessory rail configured to support a secondary accessory wherein the secondary-accessory rails are arranged to extend along opposing left and right sides of the board, wherein each secondary-accessory rail includes a beam arranged outside the footprint of the board when the accessory flat-top panel is viewed from above the top side of the board and a plurality of spacers extending from the beam toward the board.

4. The accessory flat-top panel of claim 1, wherein the first latch is coupled to the first rail receiver to pivot relative to the first rail receiver about a first latch axis to move from the disengaged position to the engaged position.

5. The accessory flat-top panel of claim 4, wherein the first rail receiver included in the left attachment pylon forms a downwardly-opening channel that faces away from the board.

6. An accessory flat-top panel for use with a surgical table, the accessory flat-top panel comprising a board adapted to support at least a portion of a patient, the board having a front, a back opposite the front, a left side, a right side opposite the left side, a top, and a bottom opposite the top, a left attachment pylon coupled to the board and arranged along a left side of the board, the left attachment pylon including a first rail receiver formed to include a channel sized to receive at least a portion of a rail included in a surgical table and a first latch movable relative to the first rail receiver from a disengaged position in which the first latch allows movement of the first rail receiver relative to a rail received in the first rail receiver to an engaged position in which the first latch resists movement of the first rail receiver relative to a rail received in the first rail receiver, and a right attachment pylon coupled to the board and arranged along a right side of the board, the right attachment pylon including a second rail receiver formed to include a channel sized to receive at least a portion of a rail included in a surgical table and a second latch movable relative to the second rail receiver from a disengaged position in which the second latch allows movement of the second rail receiver relative to a rail received in the second rail receiver to an engaged position in which the second latch resists movement of the second rail receiver relative to a rail received in the second rail receiver, wherein the channel formed by the left attachment pylon and the channel formed by the right attachment pylon are arranged within a width of the board when the accessory flat-top panel is viewed from the front of the board, wherein the left attachment pylon includes a third rail receiver sized to receive at least a portion of a rail included in a surgical table and a third latch movable relative to the third rail receiver from a disengaged position in which the third latch allows movement of the third rail receiver relative to a rail received in the third rail receiver to an engaged position in which the third latch resists movement of the third rail receiver relative to a rail received in the third rail receiver, wherein the first rail receiver and the first latch of the left attachment pylon cooperate to form a first clamp arranged along the front of the board and the third rail receiver and the third latch cooperate to form a second clamp spaced apart from the first clamp and arranged along the back side of the board, and wherein the left attachment pylon includes a coupler beam coupled to the board via fasteners that extend through the board and that extends from the first clamp to the second clamp along most of the left side of the board, and the coupler beam is spaced apart from the channel formed by the left attachment pylon.

7. A surgical support comprising a foundation frame, a support top mounted to the foundation frame, the support top including a left rail, a right rail, a first crossbeam that extends from the left rail to the right rail, and a second crossbeam that extends from the left rail to the right rail, and an accessory flat-top panel coupled to the left rail and to the right rail, the accessory flat-top panel including:

a board adapted to support at least a portion of a patient, a left attachment pylon coupled to the board and arranged along a left side of the board, the left attachment pylon including a first rail receiver formed to include a channel sized that receives at least a portion of a rail included in a surgical table and a first latch movable relative to the first rail receiver from a disengaged position in which the first latch allows movement of the first rail receiver relative to a rail received in the first rail receiver to an engaged position in which the first latch resists movement of the first rail receiver relative to a rail received in the first rail receiver, a right attachment pylon coupled to the board and arranged along a right side of the board, the right attachment pylon including a second rail receiver formed to include a channel sized that receives at least a portion of a rail included in a surgical table and a second latch movable relative to the second rail receiver from a disengaged position in which the second latch allows movement of the second rail receiver relative to a rail received in the second rail receiver to an engaged position in which the second latch resists movement of the second rail receiver relative to a rail received in the second rail receiver, and a secondary-accessory rail configured to support a secondary accessory, the secondary-accessory rail spaced apart from the board, arranged to extend along at least a portion of either the left side or the right side of the board, and coupled directly to either the left attachment pylon or the right attachment pylon, wherein the channel formed by the left attachment pylon and the channel formed by the right attachment pylon are arranged within a width of the board when the accessory flat-top panel is viewed from a front of the board.

8. The surgical support of claim 7, wherein the first rail receiver forms a downwardly-opening channel that faces away from the board.

9. The surgical support of claim 7, wherein the first latch is coupled to the first rail receiver to pivot relative to the first rail receiver about a first latch axis that extends parallel to the left rail to move from the disengaged position to the engaged position.

10. The surgical support of claim 7, wherein the foundation frame includes a central connection member, a first column coupled to a first end of the central connection member and arranged to extend upwardly from the central connection member, and a second column coupled to a second end of the central connection member opposite the first end of the central connection member and arranged to extend upwardly from the central connection member.

11. The surgical support of claim 10, wherein the support top extends between the first column and the second column and is mounted to the first column and the second column for movement about a support-top axis relative to the first column and the second column.

* * * * *